US009866964B1

(12) United States Patent
Haskin et al.

(10) Patent No.: US 9,866,964 B1
(45) Date of Patent: Jan. 9, 2018

(54) SYNCHRONIZING AUDIO OUTPUTS

(71) Applicant: Amazon Technologies, Inc., Seattle, WA (US)

(72) Inventors: Menashe Haskin, Palo Alto, CA (US); Kavitha Velusamy, San Jose, CA (US); Daniel Christopher Bay, Santa Clara, CA (US); Jason Zimmer, Santa Clara, CA (US)

(73) Assignee: Amazon Technologies, Inc., Seattle, WA (US)

( * ) Notice: Subject to any disclaimer, the term of this patent is extended or adjusted under 35 U.S.C. 154(b) by 675 days.

(21) Appl. No.: 13/779,604

(22) Filed: Feb. 27, 2013

(51) Int. Cl.
*H04R 5/04* (2006.01)

(52) U.S. Cl.
CPC ..... *H04R 5/04* (2013.01)

(58) Field of Classification Search
CPC .... H04R 2227/005; H04R 27/00; H04R 3/12; H04R 1/326; H04R 2227/003; H04R 2420/01; H04R 2420/07; H04R 2430/01; H04R 2430/20
USPC .... 381/17–23, 56–58, 94.1–94.3, 92, 95–98; 700/94
See application file for complete search history.

(56) References Cited

U.S. PATENT DOCUMENTS 7,054,448 B2 * 5/2006 Yoshino ..... H04S 7/301 381/103
7,231,054 B1 * 6/2007 Jot ..... H04S 3/00 381/18
7,418,392 B1 8/2008 Mozer et al.
7,720,683 B1 5/2010 Vermeulen et al.
7,774,204 B2 8/2010 Mozer et al.
7,864,631 B2 * 1/2011 Van Leest ..... H04S 7/301 367/124
8,098,841 B2 * 1/2012 Sawara ..... H04R 27/00 381/83
8,165,317 B2 * 4/2012 Ichikawa ..... G01S 5/30 367/118
2007/0140510 A1 * 6/2007 Redmann ..... G10H 1/0058 381/97
2012/0223885 A1 9/2012 Perez
2012/0263306 A1 * 10/2012 McGowan ..... H04R 1/403 381/17
2013/0154930 A1 * 6/2013 Xiang ..... G06F 3/167 345/158

(Continued)

FOREIGN PATENT DOCUMENTS

WO WO2011088053 A2 7/2011

OTHER PUBLICATIONS

Pinhanez, "The Everywhere Displays Projector: A Device to Create Ubiquitous Graphical Interfaces", IBM Thomas Watson Research Center, Ubicomp 2001, Sep. 30-Oct. 2, 2001, 18 pages.

*Primary Examiner* — Lun-See Lao
(74) *Attorney, Agent, or Firm* — Lee & Hayes, PLLC

(57) ABSTRACT

A computing system with multiple audio devices local to an environment to provide synchronized audio output to a user. A remote system receives a local audio signal representing sound captured from an environment from a local audio device and a remote audio signal representing sound captured from the environment from the remote audio device. The server determines a delay associated with the local audio signal and a delay associated with the remote audio signals and, based on the delays, synchronizes the audio being output by the local and remote devices.

21 Claims, 7 Drawing Sheets

(56) References Cited

U.S. PATENT DOCUMENTS

2014/0294201 A1* 10/2014 Johnson ..... H04S 7/301
381/107

* cited by examiner

SYNCHRONIZING AUDIO OUTPUTS

BACKGROUND

The use of whole home surround sound and ubiquitous computing devices is becoming more and more common. Many new homes and offices are built fully wired, while many old homes and offices utilize various wireless systems. Many different ways have been introduced to allow users to interact with computing devices, such as through mechanical devices (e.g., keyboards, mice, etc.), touch screens, motion, gesture, and even through natural language input such as speech.

As computing devices in homes and offices continue to evolve, users expect a more seamless experience when moving from room to room or from device to device. One of the challenges for multi-device home or office systems is how to coordinate the multiple devices to effectively perform tasks.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features.

DETAILED DESCRIPTION

Overview

Figure 1:
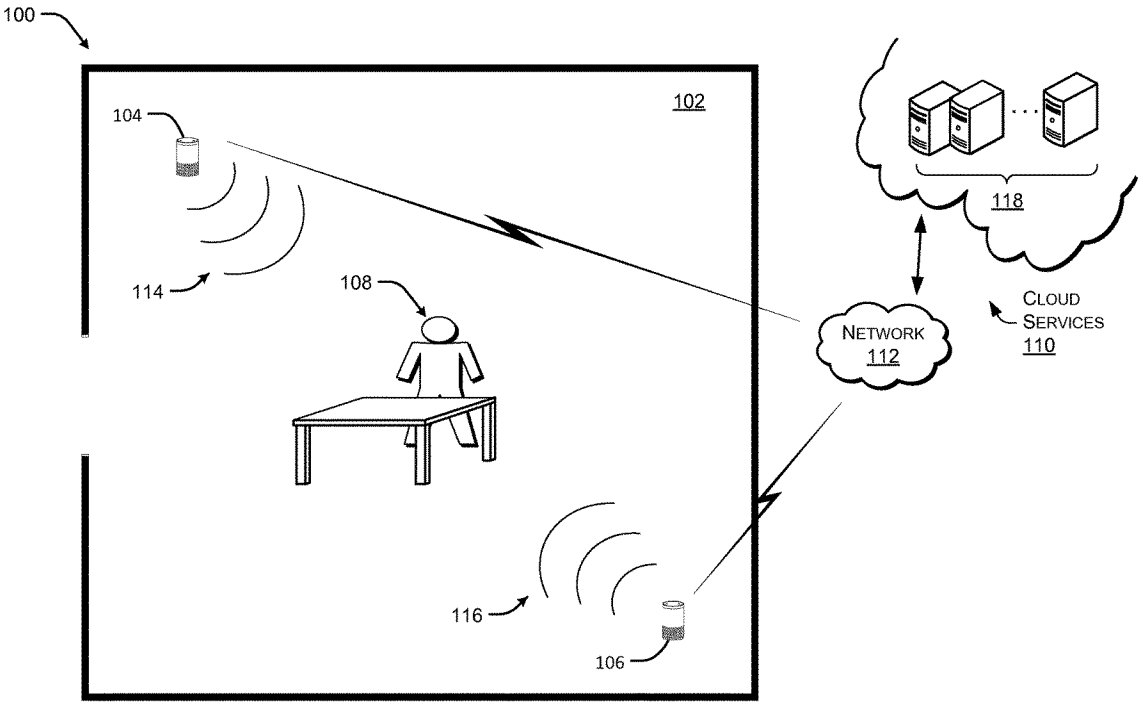
FIG. 1 illustrates an example environment including a room with multiple audio devices.

This disclosure includes techniques and implementations to improve acoustic performance of home and office computing systems, such as surround sound systems. One way to improve acoustic performance is to synchronize the audio output from each audio device of the computing system. For instance, in systems with multiple audio devices, each audio device may have a unique delay or lag due to network delays or buffer fullness of one or another of the devices. As a result, the audio may be output at different rates, which may unfortunately adversely degrade user experiences and reduce user satisfaction.

The techniques described herein achieve audio output synchronization by configuring the audio devices to be aware of the audio being output by the other audio devices and to capture sound present in the acoustic environment. Accordingly, the audio devices are equipped with one or more microphones to capture the audio in the environment, as well as one or more speakers to output the audio. In some situations, the audio devices may function independently from one another, being equipped with computing and/or memory capabilities, and hence capturing output of other audio devices helps each device synchronize with one another.

In one implementation, each of the audio devices is aware of the audio being output by the other devices, such as through a wireless network (e.g., Wifi, Bluetooth®, etc.). Each of the devices is also configured to capture sounds from the acoustic environment and identify the audio outputs of the other devices. Each of the audio devices is, thus, able to determine a delay associated with the audio output from each the other devices and to adjust a playback offset of the output of its own audio to synchronize with the other devices.

As one example scenario, suppose two audio devices (device A and device B) are installed in a room as part of a surround sound system. Both device A and device B are configured to output coordinated audio signals (such as a song or tracks accompanying a television program) and to capture sounds from the room with one or more microphones when the sound system is activated. Device A and device B are aware of the audio the other is outputting, such that device A is able to detect and identify the audio output by device B and device B is able to detect and identify the audio output by device A. Device A measures a delay of the audio output by device B and device B measures a delay of the audio output by device A.

The delays are compared and if the delay measured by device B is greater than the delay measured by device A (i.e. the audio output by device A is behind the audio output by device B), a playback offset equal to the difference in the delays may be applied to the audio output by device B to substantially synchronize the audio outputs. Similarly, if the delay measured by device A is greater than the delay measured by device B (i.e. the audio output by device B is behind the audio output by device A), a playback offset equal to the difference in the delays may be applied to the audio output by device A to substantially synchronize the audio outputs.

In another instance of the example scenario above, the audio devices A and B may also adjust the playback offsets to synchronize the audio outputs to reach a given location in the room in unison. For instances, the audio device A may apply a playback offset less than the difference between the measured delays to the audio output by device A to synchronize the audio outputs for a location in the room closer to audio device B than to audio device A. In some instances, both device A and device B may apply a playback offset to adjust the audio outputs for a given location.

In one particular implementation, sound localization techniques or triangulation may be applied, using multiple audio devices, to noise associated with a user in the room, home or office to determine the location of the user and to adjust the playback offsets associated with each of the audio devices, such that the audio output reaches the location of the user in unison.

For example, the audio devices may be configured to detect noise associated with listeners (such as footsteps, talking, spoken command words, or even eating popcorn) or the audio devices may ask the user a question such as "where are you" to which the user may respond with a word, phrase or command, such as "I am here". The audio devices may then identify the word, phrase or command. Based on the time of identification, known locations of the audio devices and/or delays associated with the phrase as determined by the each audio device, the system is able to determine the distance of the user from each of the audio devices and/or the user's location.

In some implementation, the various operations to implement audio synchronization among multiple audio devices may be split among the audio devices and remote cloud computing systems to which the audio devices may be coupled via a network. Different modules and functionality may reside locally in the audio devices proximal to the user, or remotely in the cloud servers. For instance, a cloud system or central control system may perform the calculations to coordinate the playback offsets of the audio devices of a system. For example, the cloud system may receive data related to the audio output and captured by each of the audio devices. The cloud system may determine delays between the audio devices and synchronize the audio outputs by applying playback offsets to at least some of the audio devices.

Illustrative Environment

FIG. 1 illustrates an example environment 100 including a room 102 with multiple audio devices 104 and 106. The audio devices 104 and 106 may be implemented as any of a number of devices and in any number of ways, such as a wired or cellular telephones, various mobile and stationary computing devices, conferencing devices, various speaker systems, and/or any number of other electronic devices capable of capturing sound at one or more microphones and output audio at one or more speakers. In one particular example, the audio devices are voice controlled assistant devices which are configured to assist users in performing various tasks by receiving verbal requests and providing audible responses.

In the illustrated implementation, the audio devices 104 and 106 are positioned in opposite corners of room 102. In other implementations, the audio devices 104 and 106 may be placed in any number of places (e.g., an office, store, public place, etc.) or locations (e.g., ceiling, wall, in a lamp, beneath a table, under a chair, etc.). In one particular example, the audio devices 104 and 106 may be configured to communicate with other electronic devices within the room 102 to capture environmental noise and synchronize audio outputs.

As illustrated, the acoustic environment 100 includes a user 108 surrounded by the audio devices 104 and 106. Generally, each of the audio devices 104 and 106 include one or more speakers to output audio into the room 102. As illustrated, the audio device 104 produces audio output 114 and the audio device 106 produces audio output 116. The audio outputs 114 and 116 combine to create an acoustic environment and may be reproductions of the same audio content (such as a song) or individual parts of an overall acoustic environment (such as directional sounds accompanying a television program). The audio devices 104 and 106 also include one or more microphones to capture audio from the room 102.

The audio devices 104 and 106 are illustrated in wireless communication with cloud services 110 via network 112. In other instances, the audio devices 104 and 106 may be in communication with the cloud services 110 through a wired communication system. The cloud services 110, generally, refer to a network accessible platform implemented as a computing infrastructure of processors, storage, software, data access, and so forth that is maintained and accessible via the network 112, such as the Internet. The cloud services 110 do not require end-user knowledge of the physical location and configuration of the system that delivers the services. Common expressions associated with cloud services include "on-demand computing", "software as a service (SaaS)", "platform computing", "network accessible platform", and so forth.

The cloud services 110 are implemented by one or more servers, such as servers 118. Additionally, the servers 118 may host any number of cloud based services 110, such as a music system to stream music to the audio devices 104 and 106. These servers 118 may be arranged in any number of ways, such as server farms, stacks, and the like that are commonly used in data centers.

In one implementation, the cloud services 110 are configured to synchronize the audio outputs of the audio devices 104 and 106 and/or locate the position of the user 108 within the room 102. In other implementations, one of the audio devices 104 and 106 may be configured to synchronize the audio outputs, or a central local control devices such as a set-top box or home computer may synchronize the audio outputs, or the audio devices 104 and 106 and cloud services 110 may each be configured to perform some of the processes associated with synchronizing the audio outputs and/or locating the user.

In an example scenario, the user 108 may be eating breakfast while listening to the morning news via the audio devices 104 and 106. In this example, cloud service 110 may be streaming the morning news to the audio devices 104 and 106 via a web cast and the audio output 114 and 116 produced by the audio devices 104 and 106 is similar. For instance, a news anchor may be discussing facts related to a police investigation. However, due to network delays, packet drops and/or buffer length, the audio outputs 114 and 116 of the news anchor's discussion output by the audio devices 104 and 106 may be at slightly different rates causing user 108 to experience something like an echo effect or double talk.

To improve overall user experience, each of the audio devices 104 and 106 captures sounds present in the room 102 and converts the sounds into audio signals. For example, the audio device 104 captures sound including the audio output 116 from the audio devices 106 and provides the captured sounds to the cloud services 110. Since the cloud services 110 is aware of the audio output by each of the audio devices 104 and 106 (e.g., the cloud services 110 is streaming the news program), the cloud services 110 is able to identify the audio output 114 produced by the audio device 104 in the sounds captured by the audio device 106 and the audio output 116 produced by the audio device 106 in the sounds captured by the audio device 104.

The cloud services 110 determine a first delay associated with the audio output 114 as captured by the audio device 106 and a second delay associated with the audio output 116 as captured by the audio device 104. The cloud services 110 compare the first and second delay to determine if the audio outputs 114 and 116 are synchronized. For instance, if the first delay equals the second delay within a pre-determined threshold, the audio devices 104 and 106 are deemed to be synchronized. In another example, the first delay and second delay may be synchronized if the delays would cause the audio outputs to reach a particular location within the room (such as the table) in unison.

If the delays are not synchronized, the cloud services 110 determine which of the audio devices 104 and 106 is ahead and by how much. For instance, if the first delay is greater than the second delay, the audio device 104 is ahead of the audio device 106. The cloud services 110 may apply a playback offset or delay to the audio output 114 being streamed to the audio device 104 equal to the difference to synchronize the outputs 114 and 116. Likewise, if the second delay is greater than the first delay, the audio device 104 is ahead of the audio device 106. The cloud services 110 may apply a playback offset to the audio output 116 being streamed to the audio device 106 to synchronize the outputs 114 and 116.

In other implementations, the audio device 104 may be ahead if the cloud services 110 determines from the relative delays that the audio output 114 reaches a particular location (such as the table) ahead of the audio output 116. The cloud services 110 may apply playback offsets to the audio output 114 being streamed to the audio device 104 to synchronize the outputs 114 and 116.

In some instances, the cloud services 110 may have difficulty in identifying the audio output 114 by the audio device 104 in the sound captured by audio device 106 and the audio output 116 by the audio device 106 in the sound captured by audio device 104 as the audio outputs are similar. For example, the audio device 106 may capture sound containing both the audio output 114 by the audio device 104 and a reverberation of the audio output 116. In some situations, the cloud services 110 may need assistance in identifying the reverberation from the audio output 114.

If the cloud services 110 experience difficulty in identifying an audio output due to reverberations, the cloud services 100 may cause the audio device 106 to shift the timing of the audio output 116, for instance via a playback offset. By shifting the audio output 116, the cloud services 110 are able to detect the shift in the captured sound associated with the reverberations and, thus, to correctly identify the audio output 114 from the reverberations.

In some scenarios, the audio output by the audio device 104 and 106 may not always be the same. For example, the user 108 may again be eating breakfast while listening to a web cast of the morning news via the audio devices 104 and 106. However in this example, the cloud service 110 may be streaming audio related to a news reporter interviewing a police officer. A camera man may be located between the two, such that the news reporter is to the right of the camera and the police officer to the left. In this situation, the cloud services 110 may cause the audio associated with the news reporter to be output by the audio device 104 (the device to the right of the user 108) and the audio associated with the police officer to be output by the audio device 106 (the device to the left of the user 108) to cause the user 108 to feel like he is participating in the interview.

The audio devices 104 and 106 capture sound present in the room 102 and convert the sound into audio signals. The audio devices 104 and 106 provide the captured sounds to the cloud services 110. Since the cloud services 110 are aware of the audio output by each of the audio devices 104 and 106 (e.g., once again, the cloud services 110 is aware of the interview being streamed), the cloud services 110 may identify the audio associated with the news reporter, output by the audio device 104, in the sound captured by the audio device 106 and the audio associated with the police officer, output by the audio device 106, in the sound captured by the audio device 104.

The cloud services 110 determine a first delay associated with the audio output 114 and a second delay associated with the audio output 116. The cloud services 110 may then compare the first and second delays and apply playback offsets on either or both of the audio devices 104 and 106 to synchronize the audio outputs 114 and 116.

In one particular implementation, the cloud services 110 may compare the first and second delays to expected delays to synchronize the outputs 114 and 116. For instance, the cloud services 110 may calculate the expected delays based on the audio outputs 114 and 116, the locations of the audio devices 104 and 106 and a desired synchronization location (the location at which the audio outputs 114 and 116 should reach in unison). If either the first delay or the second delays does not equal the respective expected delay, the cloud services 110 may apply playback offsets on either or both of the audio devices 104 or 106 to synchronize the outputs 114 and 116 for the desired synchronization location.

Figure 2:
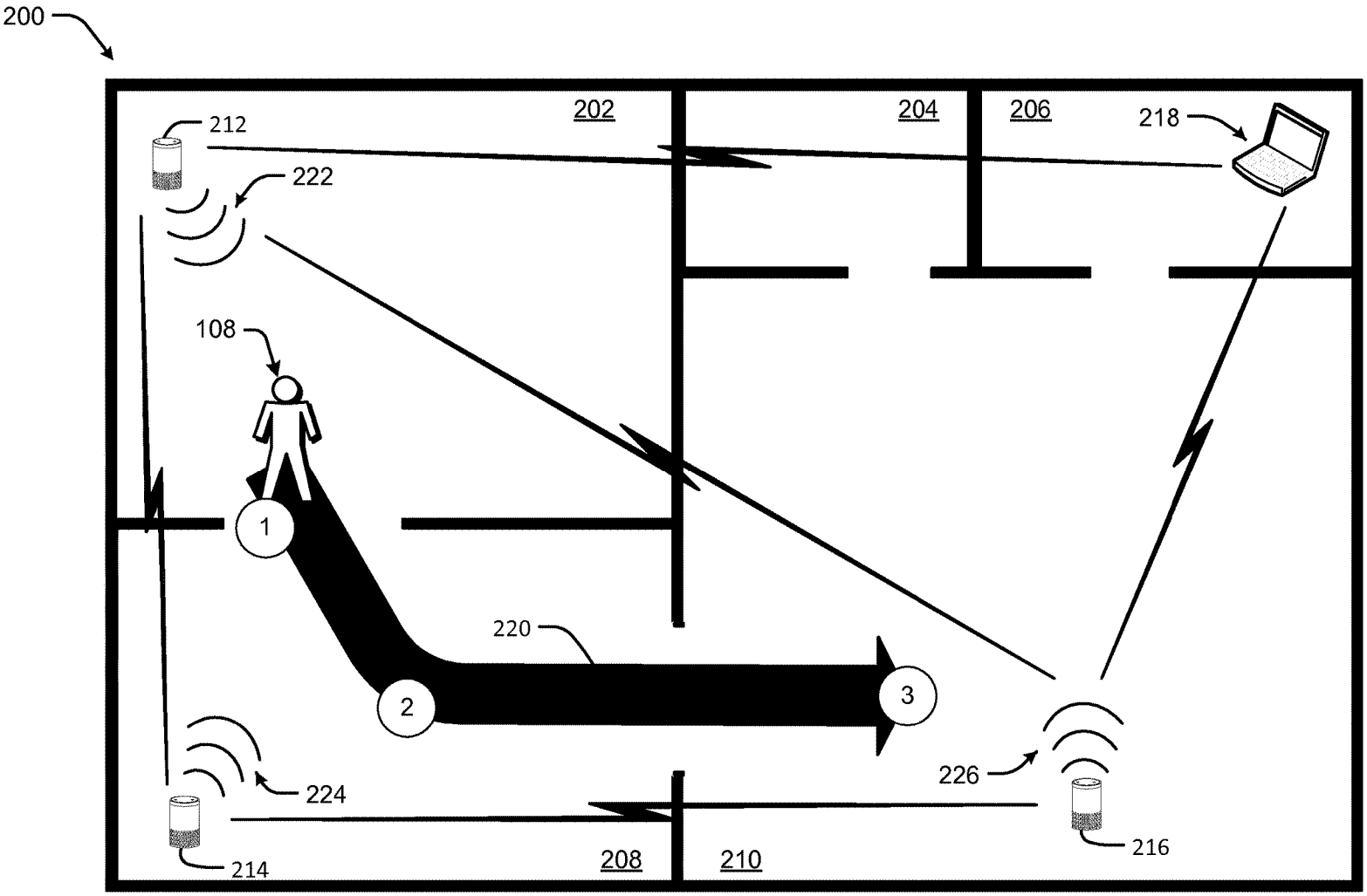
FIG. 2 illustrates another example environment including multiple rooms with multiple audio devices.

FIG. 2 illustrates another example environment 200 including multiple rooms 202, 204, 206, 208 and 210 with multiple audio devices 212, 214 and 216. In the illustrated example, user 108 is moving along path 220 from a location 1 in room 202 to location 3 in room 210 while passing through location 2 in room 208. The audio devices 212, 214 and 216 are producing audio outputs 222, 224 and 226, respectively. The illustrated example also shows a computing device 218 in communication with the audio devices 212, 214 and 216. In this example, the computing device 218 may act as a local audio store and/or perform the actions of cloud services 110 of FIG. 1 to demonstrate that the system may be integrated into the home or office of the user 108 without the need for external access.

In an example scenario, the user 108 may be playing music throughout the home via the audio devices 212, 214 and 216, as the user 108 travels from room 202 to room 210 along path 220. In one implementation, the audio devices 212, 214 and 216 synchronize the audio outputs 222, 224 and 226 to reach the location of the user 108 substantially simultaneously. Let us assume that initially, the user 108 is at location 1 in room 202 and is in range of the audio devices 212 and 214 and the audio outputs 222 and 224 are currently synchronized for location 1.

As the user 108 begins to walk, as indicated by path 220, the user 108 leaves location 1 in room 202 and enters location 2 in room 208 and the audio outputs 222 and 224 of the audio devices 212 and 214 are no longer synchronized for the user 108. For example, at location 2 the audio output 224 would be ahead of audio output 222, as the user 108 is closer to the audio device 214.

In one implementation, the audio devices 212 and 214 capture the sound associated with the user 108 (such as footsteps) from the environment 200. Each of audio device 212 and audio device 214 is able to identify the footsteps within the captured sounds and determine the time at which the footsteps are captured and/or delays associated with the footsteps relative to the capturing audio device. Thus, the audio device 212 is able to determine a first delay and the audio device 214 is able determine a second delay. Either, the audio device 212, the audio device 214 or computing device 218 may then apply sound localization or triangulation techniques to identify location 2 in room 208 as the new location of the user 108.

Once location 2 is identified, adjusted playback offsets for the audio device 212 and 214 may be calculated such that the audio outputs 222 and 224 reach location 2 synchronously. For instance, an additional offset may be applied to audio output 224 by the audio device 214 to compensate for the increased distance between the user 108 and the audio device 212. These playback offsets may be computed by the local computing device 218, one or more of the audio devices 212, 214, and 216, or a combination of these devices.

As the user 108 moves to location 2 in room 208, the user 108 may also move into range of the audio device 216. In this instance, the audio device 216 may also detect the footsteps. By having additional audio devices identify the sounds associated with the user 108, the sound localization or triangulation techniques may more accurately determine location 2 as the location of the user 108.

The user 108, now, moves from location 2 to location 3 along pathway 220, the audio devices 212, 214 and 216 continue to track the footsteps of the user 108 and to adjust playback offsets, such that the audio outputs 222, 224 and 226 continue to reach the user 108 synchronously. When the user 108 reaches location 3, the audio device 212 may have moved out of range. However, the audio devices 214 and 216 continue to capture sound from environment 200, detect sounds associated with the user 108, and identify the location of the user 108 using sound localization or triangulation techniques. In some implementations, the audio devices 212, 214 and 216 or computing device 218 may apply multiple sound localization or triangulation techniques in parallel to more accurately determine the location of the user 108.

In one particular example, the audio devices 212, 214 and 216 may recalculate playback offsets continuously, such that the audio outputs 222, 224 and 226 track the movements of the user 108 in real time and reach the user 108 synchronously at any location along path 220. In another example, the audio devices 212, 214 and 216 may be configured to identify the location of the user 108 in response to identifying a voice command, such as "synchronize sound," within the captured sounds. In another particular example, the audio devices 212, 214 and 216 may periodically ask the user a question in order to determine the location based on the spoken response. For instance, the audio devices 212, 214 and 216 may ask "where are you" and the user 108 would respond "I am here". Based on the delays associated with the response, the audio devices 212, 214 and 216 are able to identify the location of the user 108 and adjust playback offsets accordingly.

In another implementation, other devices (e.g., camera, depth device, etc.) may be used in coordination with, or separate from, the audio devices to detect movement of the user throughout the rooms from location 1, to location 2, and to location 3. For instance, various optical devices positioned in the rooms 202, 208, and 210 may capture visual images of the user as the user moves through the three locations. This visual information may be used to confirm location of the user and aid in determining location of the user for purposes of synchronizing audio output.

Illustrative Architecture

Figure 3:
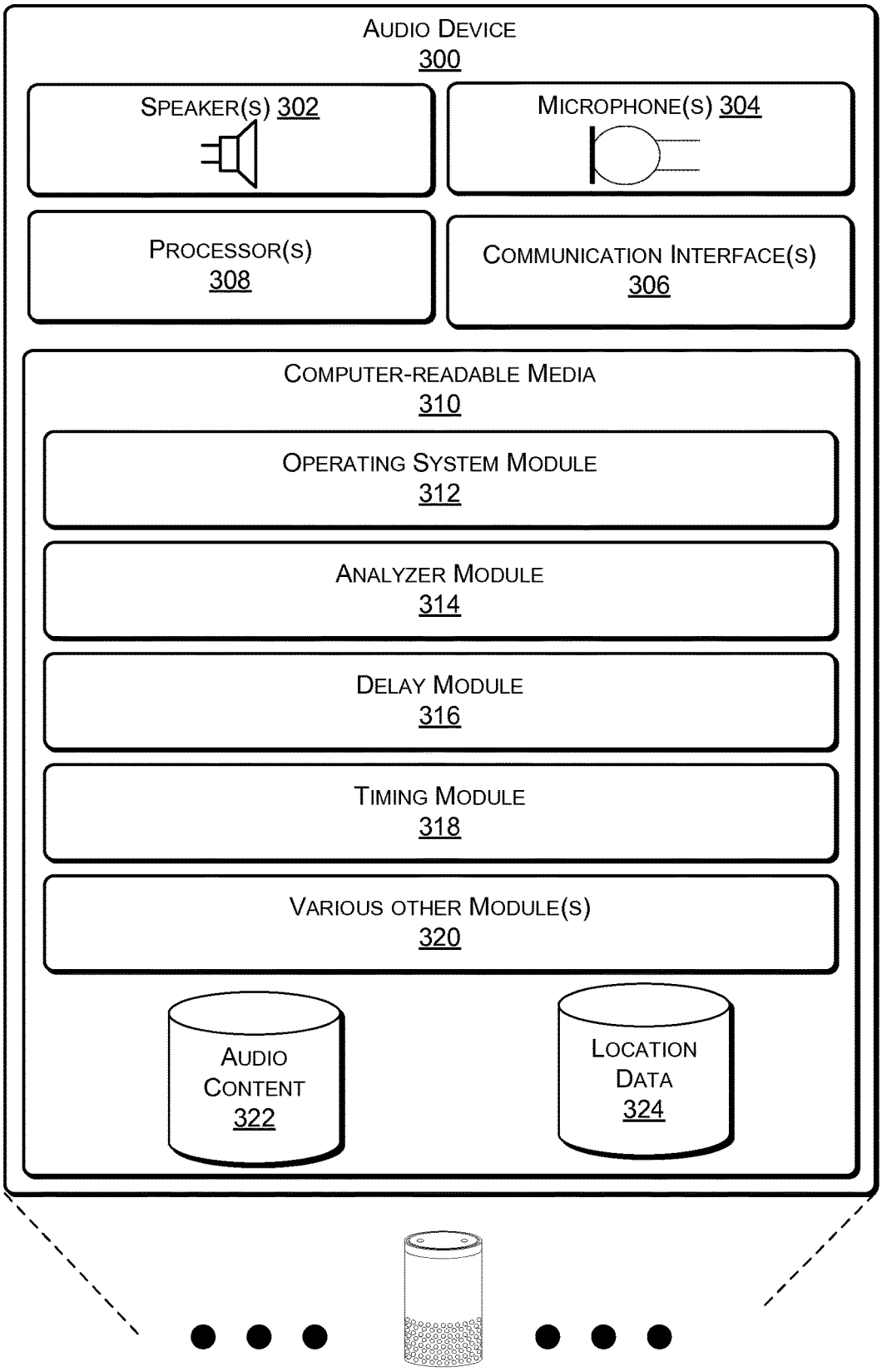
FIG. 3 illustrates an example architecture of an audio device.

FIG. 3 illustrates an example of an audio device 300, such as the audio devices 104, 106, 212, 214 and 216 of FIGS. 1 and 2. Generally, the audio device 300 may be implemented as a standalone device that is relatively simple in terms of functional capabilities with limited input/output components, memory and processing capabilities or as part of a larger electronic system.

The audio device 300, generally, includes one or more speakers 302 to reproduce audio signals as sound into an environment and one or more microphones 304 to capture sound from the environment and convert the sound into audio signals. The microphones 304 may be a microphone array, a calibrated group of microphones, or multiple microphone arrays or calibrated groups. In some examples, microphones 304 may be incorporated with an analog-to-digital converter to convert the sound into digital microphone output signals for processing.

The audio device 300 also includes one or more communication interfaces 306 to facilitate communication between one or more networks (such as network 112 of FIG. 1) and/or one or more cloud services (such as cloud services 110 of FIG. 1). The communication interfaces 306 may support both wired and wireless connection to various networks, such as cellular networks, radio, WiFi networks, short-range or near-field networks (e.g., Bluetooth®), infrared signals, local area networks, wide area networks, the Internet, and so forth.

In the illustrated implementation, the audio device 300 includes, or accesses, components such as at least one control logic circuit, central processing unit, one or more processors 308, in addition to one or more computer-readable media 310 to perform the function of the audio device 300 and or store media content. Additionally, each of the processors 308 may itself comprise one or more processors or processing cores.

Depending on the configuration of the audio device 300, the computer-readable media 310 may be an example of tangible non-transitory computer storage media and may include volatile and nonvolatile memory and/or removable and non-removable media implemented in any type of technology for storage of information such as computer-readable instructions or modules, data structures, program modules or other data. Such computer-readable media may include, but is not limited to, RAM, ROM, EEPROM, flash memory or other computer-readable media technology, CD-ROM, digital versatile disks (DVD) or other optical storage, magnetic cassettes, magnetic tape, solid state storage, magnetic disk storage, RAID storage systems, storage arrays, network attached storage, storage area networks, cloud storage, or any other medium that can be used to store information and which can be accessed by the processors 308.

Several modules such as instruction, data stores, and so forth may be stored within the computer-readable media 310 and configured to execute on the processors 308. An operating system module 312 is configured to manage hardware and services (e.g., communication interfaces, microphones, and speakers) within and coupled to the audio device 300 for the benefit of other modules. An analyzer module 314 is provided to analyze the sound captured by the microphones 304 to detect specific audio signals within captured sound. A delay module 316 is provided to determine delays associated with the captured sounds. A timing module 318 is provided to adjust the playback offsets associated with the output of speakers 302. Various other modules 320 may also be stored on computer-readable storage media 310, such as a configuration module to assist in an automated initial configuration of the audio device 300, as well as reconfigure the audio device 300 at any time in the future.

In some implementations, the computer-readable media 310 may also store audio content 322 and location data 324. The audio content 322 includes media, such as songs, radio recordings, and/or speech files, which can be output by speakers 302 as audible sounds. The location data 324 may include the location of the audio device 300, the location of various other audio devices or electronics in the same environment, and/or various locations in the environment favored by the user.

Generally, the audio device 300 is incorporated into a system including other audio devices located at various other locations within a room or acoustic environment. In one example when the audio device 300 is activated, the audio device 300 reproduces audio content 322 as audible sound at speakers 302 as part of an computing or audio system in conjunction with the other audio devices. In some instances, the audio content 322 is stored locally in computer-readable media 310. In other instances, the audio content 322 may be streamed or received from one or more cloud services via the communication interfaces 306.

As the audio device 300 outputs the audio content 322, the microphones 304 capture sound from the acoustic environment and convert the sound into audio signals. The audio signals are then analyzed by the processors 308 executing the analyzer module 314. The analyzer module 314 causes the processors 308 to identify the audio output by the other or remote audio devices associated with the audio content 322. For example, the audio device 300 may be made aware of the audio output by the other devices from the one or more cloud services streaming the audio content 322 to the audio device 300 or from a local wireless signal from the other audio devices.

Once the audio output of the other audio devices is identified, the processors 308 execute the delay module 316 which determines a delay of the audio output by the other audio devices. For example, the delay module 316 may access the location data 324 to infer a delay based on the time the audio output was detected and the known location of the other audio devices, by comparing the times the audio output was captured by two or more of the microphones 304 or the audio device 300 may calculate the delay based on the time the audio output was detected and data related to the timing that the other audio devices received either from the cloud services or directly from the other audio devices.

The audio device 300 also receives delay information from each of the other audio devices. That is, delays calculated by each of the other audio devices with respect to the audio output by the audio device 300 are shared among the audio devices. In another example, the audio device 300 may not receive the delays; rather a central computing system or the cloud services may receive delay information from each of the audio devices.

The timing modules 318 cause the processors 302 to compare the delays calculated to the delays received to determine if the audio content 322 is synchronized. If the audio content 322 is not synchronized and the audio device 300 determines that it is ahead of at least one of the other devices, the timing module 318 calculates a playback offset which is applied to the audio content 322 before it is output by the speakers 302. In some instances, the timing module 318 may compare the difference in the delays to a threshold value and apply a playback offset to the audio content 322 if the difference is more than the threshold.

In this manner, the audio device 300 is able to synchronize the audio output by speaker 302 with the other audio devices. It should be apparent from the above discussion that if each of the audio devices, including the audio device 300, performs the operations describes herein, each of the audio devices of the audio system are able to synchronize with the audio device experiencing the greatest lag.

Figure 4:
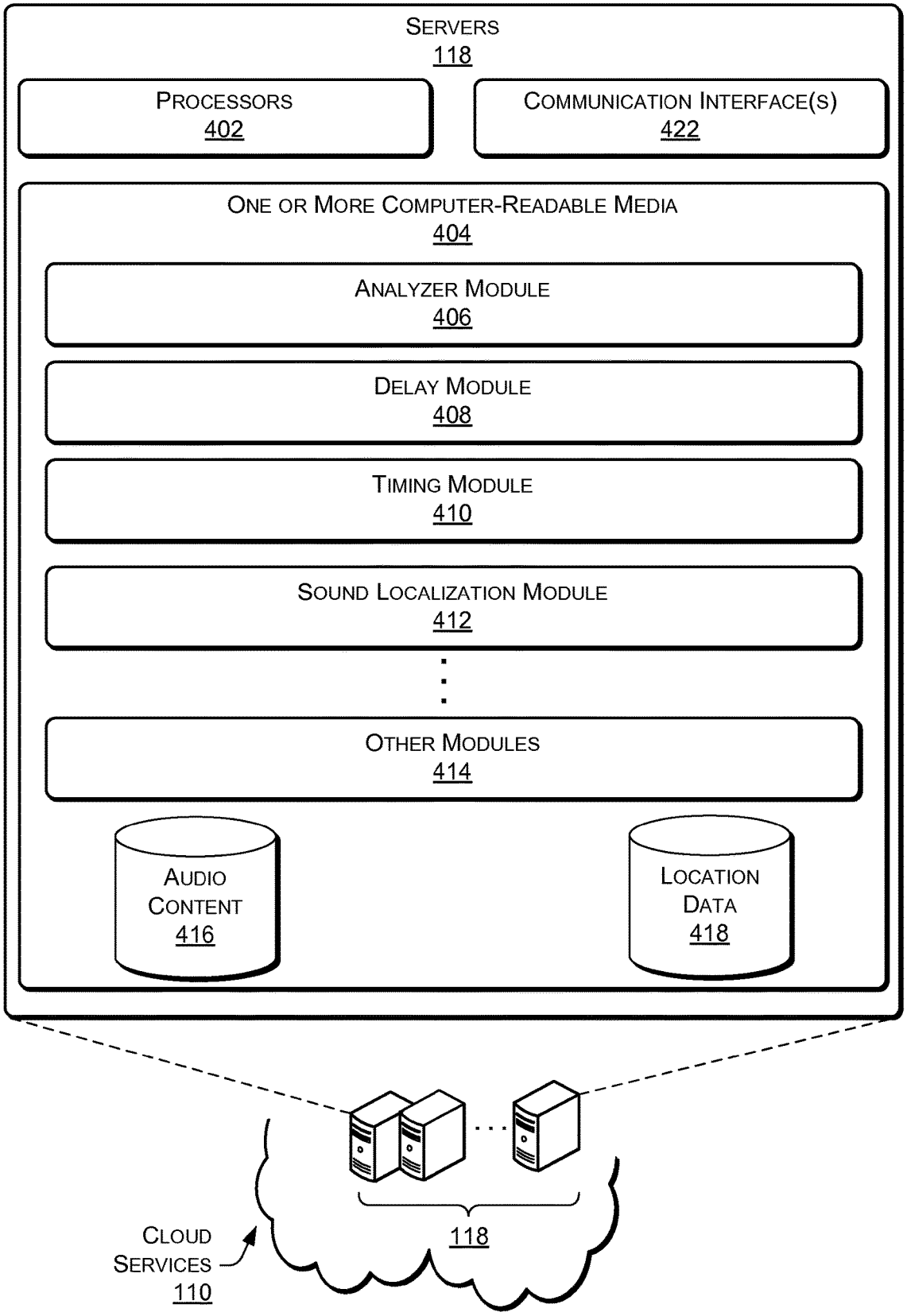
FIG. 4 illustrates an example architecture of one or more servers associated with the cloud services for synchronizing audio.

In some instances, a cloud service or remote server perform the actions of analyzing the captured sound, determining delays, and applying playback offsets to at least some of the audio devices of a sound system. FIG. 4 provides an example architecture for such a cloud system or remote server.

FIG. 4 illustrates an example architecture of one or more servers 118 associated with the cloud services 106 for synchronizing audio. The servers 118 collectively comprise processing resources, as represented by processors 402, and computer-readable storage media 404. The computer-readable storage media 404 may include volatile and nonvolatile memory, removable and non-removable media implemented in any method or technology for storage of information, such as computer-readable instructions, data structures, program modules, or other data. Such memory includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, RAID storage systems, or any other medium which can be used to store the desired information and which can be accessed by a computing device.

Several modules such as instruction, data stores, and so forth may be stored within the computer-readable media 404 and configured to execute on the processors 402. For example, an analyzer module 406 is provided to analyze the sound captured by the audio devices, a delay module 408 is provided to determine delay between the audio devices, a timing module 410 is provided to synchronize the audio devices, and a sound localization module 412 is provided to identify a location of a user within the environment. Various other modules 414 may also be stored on computer-readable storage media 404. The servers 118 are also illustrated as storing audio content 414 (such as audio files which can be streamed to the audio devices) and location data 418 associated with the audio devices and/or the user (for instance, the location data 418 may include locations favored by the user).

The servers 118 also include one or more communication interfaces 422, which may support both wired and wireless connection to various networks, such as cellular networks, radio, WiFi networks, short-range or near-field networks (e.g., Bluetooth®), infrared signals, local area networks, wide area networks, the Internet, and so forth. For example, the communication interfaces 422 may allow the cloud services 110 to stream audio to the audio devices.

In an implementation, the servers 118 stream audio content 416 to multiple audio devices (such as audio devices 104, 106, 212, 214, 216 and 300) of a computing system. In return, the servers 118 are configured to receive captured sound from the audio devices. The servers 118 analyze the captured sound by executing analyzer module 406. The analyzer module 406 causes the servers to identify the audio content 416 provided to each of the audio devices in the captured sounds received from the other audio devices.

For example, the servers 118 may stream the morning news to a first audio device and a second audio device located in a room of the user's home (such as the living room). Let us assume, for this example, that the media content 416 of the morning news includes a segment with a news reporter interviewing a police officer with a camera man located between the two, such that the servers 118 provide the audio associated with the news reporter to the first audio device and the audio associated with the police officer to the second audio device. For instance, to recreate the sound environment for the user.

In this example, the servers 118 are aware of the audio being output by the first audio device (i.e. the audio associated with the news reporter) and the audio being output by the second audio device (i.e. audio associated with the police officer), such that analyzer module 406 is able to detect and identify the audio associated with the news reporter in the captured sound provided by the second audio device and the audio associated with the police officer in the captured sound provided by the first audio device.

Once the audio of each of the first audio device and the second audio device is identified in the captured sounds provided by the other, the delay module 408 determines a first delay corresponding to the audio associated with the news reporter and a second delay corresponding to the audio associated with the police officer. After the first delay and second delays are determined by the delay module 308, the timing module 410 synchronizes the output of the first and second audio devices. For instance, the timing module 410 may compare the first and second delays to identify whether either the first audio device or the second audio device is ahead of the other. If so, the timing module 410 may apply a playback offset to the audio device that is ahead.

In some implementations, the servers 118 may determine that either the first audio device or the second audio device is ahead by comparing the first and second delays. In other implementations, the servers 118 may determine that either the first audio device or the second audio device is ahead by comparing the first delay and the second delay to expected delays calculated based on a desired synchronization location within the environment (such as a couch situated in front of the television).

In another example, the servers 118 may receive captured sounds including sounds associated with a user from the audio devices. For instance, while the user is listening to the morning news, one or more of the audio devices may have asked the user "where are you at today" and the user may have responded with the phrase "I am on the couch". The servers 118 receive the captured sounds including the phrase "I am on the couch" from each of the listening audio devices.

In some implementations, the analyzer module 406 may include instructions which cause the processors 402 to identify predetermined phrases, such "I am here," from the captured sounds. In other implementations, the analyzer module 406 may include instructions which cause the processors 402 to identify classes of sounds associated with one or more user (such as the footsteps described above with respect to FIG. 1). In one particular implementation, the analyzer module 406 may include instructions which cause the processors 402 to identify the user's voice based on prerecorded records and/or training data.

Once the analyzer module 406 detects the phrase "I am on the couch" within the captured sound signals of each of the audio devices, the servers 118 execute the sound localization module 412 to determine the location of the user with respect to the audio devices. For example, the sound localization module 412 may determine a time at which each of the devices captured the phrase "I am on the couch" and, together, with the location data 418 identify the location of the user with respect to the audio devices.

In other implementations, each of the audio devices may have an array of microphones and the sound localization module 412 can compare the captured sound from each of the microphones in the array to determine a delay with respect to the phrase "I am on the couch" for each of the audio devices. The sound localization module 412 may identify the distance of the user from each of the audio devices based on the relative delays.

In one particular implementation, the sound localization module 412 may analyze the captured sound, in addition to the analyzer module 406, to apply wave field synthesis or acoustic holography techniques, which do not necessarily require any input or action by the user to identify the user's location. Using the location or distances as determined by the sound localization module 412, the timing module 410 may cause one or more of the audio devices to apply playback offsets to synchronize the audio devices based on the location and/or distances. That is to cause the audio output from each of the audio devices to reach the user substantially simultaneously.

It should be understood that the terms "first" and "second" are used with respect to the audio devices to identify two similar audio devices operating in conjunction with each other in one environment. In other implementations, terms such as "local" and "remote", "near" and "far", etc. may be used to refer to two or more audio devices local to an environment with respect to a user.

Illustrative Processes

Figure 5:
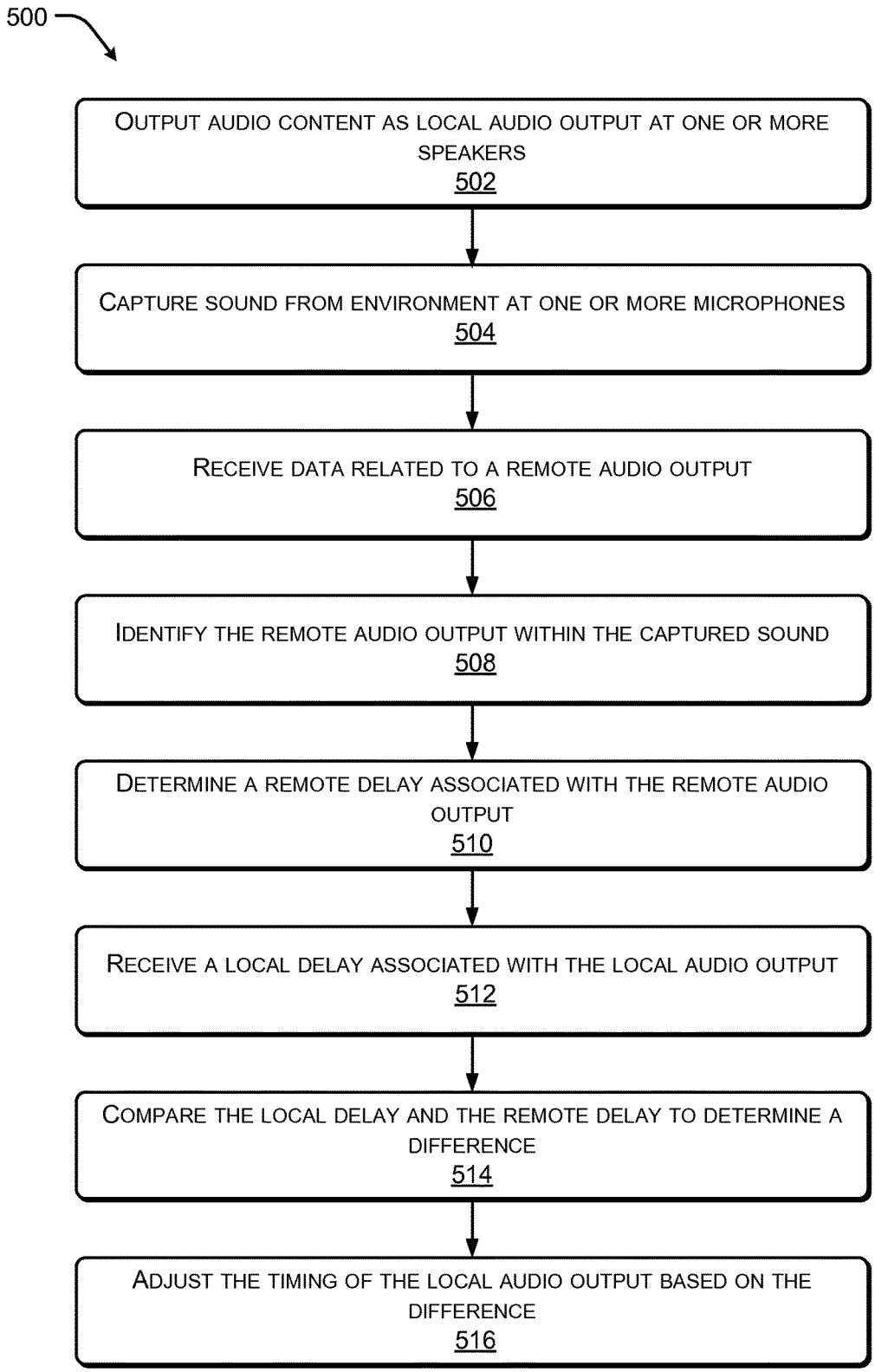
FIG. 5 is an example flow diagram showing an illustrative process for synchronizing audio outputs.
Figure 6:
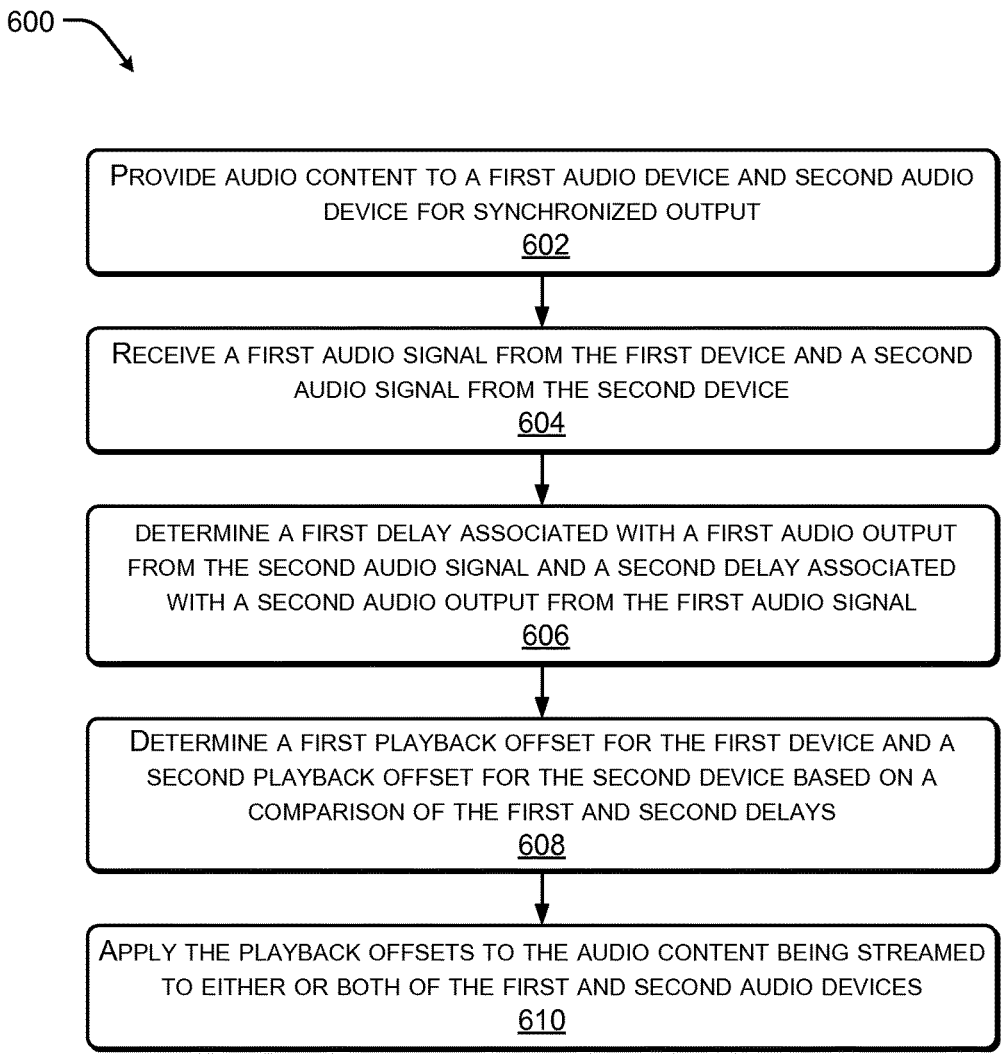
FIG. 6 is another example flow diagram showing an illustrative process for synchronizing audio outputs.
Figure 7:
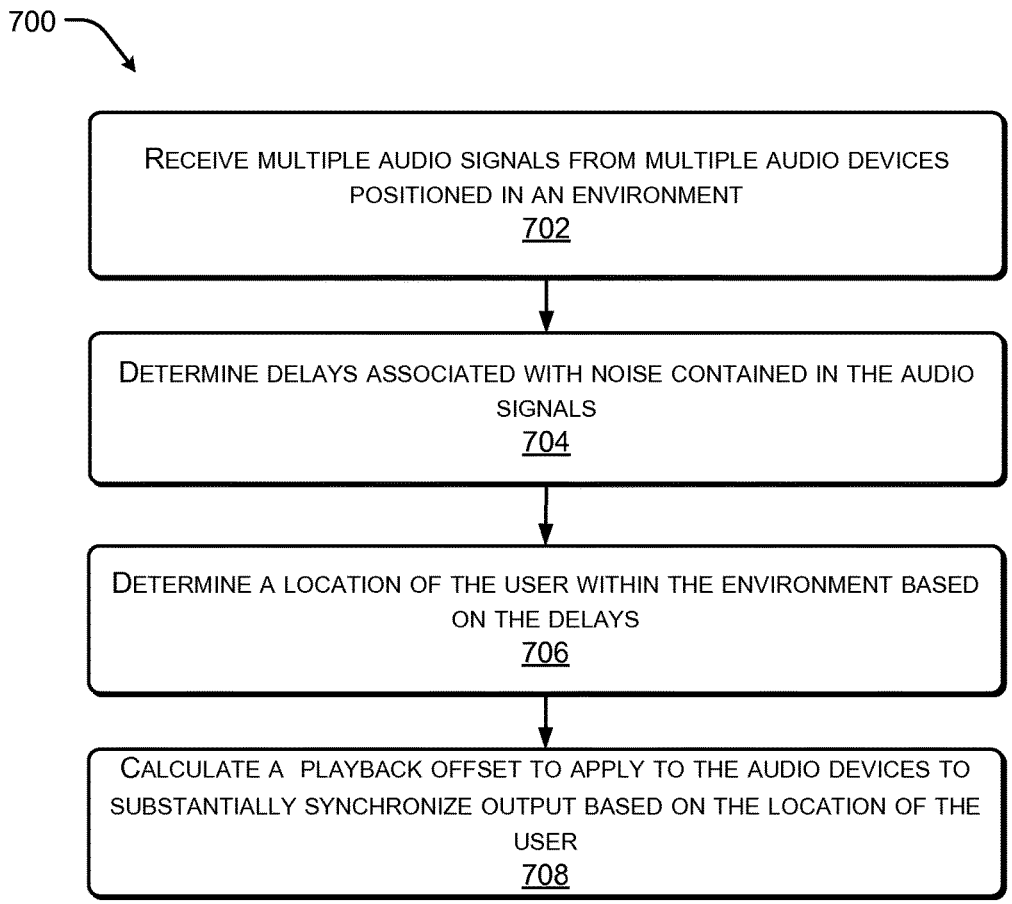
FIG. 7 is an example flow diagram showing an illustrative process for synchronizing audio outputs to a user's location.

FIGS. 5-7 are flow diagrams illustrating example processes for synchronized audio outputs. The processes are illustrated as a collection of blocks in a logical flow diagram, which represent a sequence of operations, some or all of which can be implemented in hardware, software or a combination thereof. In the context of software, the blocks represent computer-executable instructions stored on one or more computer-readable media that, which when executed by one or more processors, perform the recited operations. Generally, computer-executable instructions include routines, programs, objects, components, data structures and the like that perform particular functions or implement particular abstract data types.

The order in which the operations are described should not be construed as a limitation. Any number of the described blocks can be combined in any order and/or in parallel to implement the process, or alternative processes, and not all of the blocks need be executed. For discussion purposes, the processes herein are described with reference to the frameworks, architectures and environments described in the examples herein, although the processes may be implemented in a wide variety of other frameworks, architectures or environments.

FIG. 5 is an example flow diagram showing an illustrative process 500 for synchronizing audio outputs. Generally, the process 500 is performed by an audio device, such as audio device 104, 106, 212, 214, 216 or 300) as part of a system having multiple audio devices in communication with each other and/or one or more servers (such as servers 118). In the following discussion, the audio device performing the operations is referred to as the "local audio device," while the remaining audio devices of the system are referred to as "remote audio devices."

At 502, a local audio device outputs audio content as a local audio output at one or more speakers. For instance, the audio device may be outputting audio content stored locally or streamed from one or more cloud services via one or more networks.

At 504, the local audio device captures sound from the environment at one or more microphones. The captured sound includes the audio content as output by at least one of the remote audio devices of the audio system and may include reverberations of the local audio output by the speakers.

At 506, the local audio device receives data related to a remote audio output. For example, the local audio device may receive data that makes the local audio device aware of the audio content that encompasses the remote audio output. The data may also include data associated with the time at which the remote audio output was produced by the remote audio device. In some instances, the data is received from one or more cloud services streaming the audio content, from a computing system providing the audio content, and/or directly from the remote audio devices via a wireless signal (such as Bluetooth®).

At 508, the local audio device identifies the remote audio output within the captured sound. For example, once the local audio device receives the data related to the remote audio output, the local audio device is able to analyze the captured sound using various audio processing techniques to isolate the remote audio output.

At 510, the local audio device determines a remote delay associated with the remote audio output. For example, the local audio device may include a microphone array and the local audio device may be able to compare the sound captured at each of the microphones within the array to determine the remote delay. In other examples, the local audio device may calculate the remote delay based on the data related to the remote audio output received from the remote audio device and/or the cloud services and the captured sounds.

At 512, the local audio device receives a local delay associated with the local audio output (i.e. the audio output by the local audio device) from either one of the other audio devices (such as the remote audio device which produced the remote audio output).

At 514, the local audio device compares the local delay and the remote delay to determine a difference. The local audio device may either be ahead, behind or synchronized with the remote audio devices. For example, if the remote delay is greater than the local delay then the local audio output is ahead of the remote audio output. The audio devices are deemed to be synchronized if the difference between the local and remote delays is within a pre-defined threshold.

At 516, the local audio device adjusts the timing of the local output based on the difference determined. For example, if the local audio device is ahead of the remote device, the local audio device may apply the difference as a playback offset to substantially synchronize the local and remote audio outputs.

As just described, FIG. 5 provides a process flow for the actions preformed by the audio device in some implementations. In contrast, FIG. 6 provides a process flow for certain actions to be performed by the cloud services in some implementations.

FIG. 6 is another example flow diagram showing an illustrative process 600 for synchronizing audio outputs. Generally, the process 600 is performed by cloud services, such as cloud services 110, as part of an audio system having multiple audio devices. At 602, the cloud services provide audio content to a first audio device and a second audio device for synchronized output. For example, the cloud services may stream music or one or more broadcast to the first and second audio devices.

At 604, the cloud services receive a first audio signal from the first device and a second audio signal from the second device. For example, the first audio signal includes sound captured by the first audio device including the audio output by the second audio device and the second audio signal includes the sound captured by the second audio device including the audio output by the first audio device.

At 606, the cloud services determine a first delay associated with a first audio output from the second audio signal and a second delay associated with a second audio output from the first audio signal. For example, the cloud services may analyze the first audio signal received from the first audio device to identify and determine a delay associated with the audio output by the second audio device. Likewise, the cloud services may analyze the second audio signal received from the second audio device to identify and determine a delay associated with the audio output by the first audio device.

At 608, the cloud services determine a first playback offset for the first device and a second playback offset for the second device based on a comparison of the first and second delays. For example, if the first delay is greater than the second delay, the first audio device is ahead of the second audio device and the cloud services may apply a playback offset to the first audio device.

In other implementations, the cloud services may determine playback offsets to substantially synchronize the outputs for a given location. For instance, the cloud services may determine expected delays based on the known location of the first and second audio devices and a location in the room to synchronize the audio outputs for. The cloud services may then compare the first and second delays to the expected delays and determine if either of the audio devices are out of sync based on the variations with respect to the expected delays and each other.

At 610, the cloud services may apply the playback offsets to the audio content being streamed to the either or both of the first and second audio devices, such that the outputs of the first and second audio devices are substantially synchronized.

FIGS. 5 and 6 provide a process flow for the actions preformed to synchronize audio outputs in some implementations. FIG. 7 provides an example process flow for the actions preformed to synchronize audio outputs for a user's location.

FIG. 7 is an example flow diagram showing an illustrative process 700 for synchronizing audio outputs to a user's location. Generally, the process 700 may be performed by cloud services, such as cloud service 110, a local computing device, such as computing device 218, or by one or more of the audio devices, such as audio devices 104, 106, 212, 214, 216 or 300. At 702, the cloud services receive multiple audio signals from multiple audio devices positioned in an environment. The multiple audio signals may each include noise originating from a user.

At 704, the cloud services determine delays associated with the noise contained in the audio signals. For example, each of the audio devices may be equipped with a microphone array and the cloud services may determine the delays based on the time the noise appears in the audio signals as captured by each microphone of the microphone array. In another example, the cloud services may determine the delays based on the known locations of the audio devices and the relative time the noise appears in the audio signals from each of the audio devices.

At 706, the cloud services determine a location of the user within the environment based on the delays. For example, the cloud services may compare the delays between audio output from each of the audio devices and the delays associated with the noise to determine a location within the environment. In other examples, the cloud services may know the location of the audio devices and based on the delays associated with the noise and the locations of the audio devices determine the location of the user.

At 708, the cloud services calculate a playback offset to apply to the audio devices to substantially synchronize output based on the location of the user. For example, by imposing various playback offsets on select audio devices the cloud services can synchronize the audio output of the audio devices to arrive at the location of the user substantially simultaneously.

CONCLUSION

Although the subject matter has been described in language specific to structural features, it is to be understood that the subject matter defined in the appended claims is not necessarily limited to the specific features described. Rather, the specific features are disclosed as illustrative forms of implementing the claims.

What is claimed is:

1. A method comprising:

under control of one or more computer systems configured with executable instructions, capturing, at a local audio device, sound from an environment, the sound including: (i) first audio output by a remote audio device that is co-located with, but remote from, the local audio device, and (ii) noise generated by a user;

receiving, at the local audio device and from the remote audio device, an indication of a local delay related to second audio with respect to the first audio, the second audio being output by the local audio device;

determining, at the local audio device, a first user delay based on the noise generated by the user;

determining, at the local audio device and based on the first user delay, a distance of the user from the local audio device; and applying a playback offset to the second audio based at least in part on: (i) the distance of the user from the local audio device, and (ii) the indication of the local delay.

2. The method as recited in claim 1, further comprising:

determining a remote delay associated with the first audio; and sending an indication of the remote delay to the remote audio device.

3. The method as recited in claim 1, wherein the method further comprises:

receiving, at the local audio device, a second user delay from the remote audio device; and determining, at the local audio device, a location of the user in the environment based on the first user delay and the second user delay.

4. The method as recited in claim 3, wherein the playback offset is also based at least in part on the location.

5. The method as recited in claim 1, wherein:

applying the playback offset comprises determining a remote delay related to the first audio based on the sound captured from the environment; and the playback offset is based on a comparison of the local delay and the remote delay.

6. The method as recited in claim 1, wherein the second audio and the first audio are part of an audio content item.

7. One or more computer-readable media having computer-executable instructions that, when executed by one or more processors, cause the one or more processors to perform operations to synchronize audio output by a first audio device co-located with a second audio device, the operations comprising:

determining a first delay associated with a user from sound captured by a first microphone of the first audio device located in an environment;

determining a second delay associated with the user from sound captured by a second microphone of the second audio device, the second audio device located in the environment but remote from the first audio device; and adjusting, based at least in part on the first delay and the second delay, a playback offset of a first output signal being output by the first audio device.

8. The one or more computer-readable media as recited in claim 7, the operations further comprising:

providing the first output signal to the first audio device; and providing a second output signal to the second audio device.

9. The one or more computer-readable media as recited in claim 8, the operations further comprising:

receiving, from the first audio device, a first audio signal representative of sound output by the second audio device;

determining a third delay related to the sound output by the second audio device relative to the first audio device based on the first audio signal;

receiving, from the second audio device, a second audio signal representative of sound output by the first audio device;

determining a fourth delay related to the sound output by the first audio device relative to the second audio device based on the second audio signal; and synchronizing the first output signal and the second output signal based at least partly on the third delay and the fourth delay.

10. The one or more computer-readable media as recited in claim 9, wherein synchronizing the first output signal and the second output signal comprises:

applying a first playback offset to the first output signal by a first amount; and applying a second playback offset to the second output signal by a second amount.

11. A method comprising:

under control of one or more computer systems configured with executable instructions, receiving, at least partially over a wireless communication channel, a first audio signal from a first audio device located in an environment, the first audio signal including a sound associated with a user;

receiving, over the wireless communication channel, a second audio signal from a second audio device located in the environment but remote from the first audio device, the second audio signal including the sound associated with the user;

determining a first delay associated with the user based on the first audio signal;

determining a second delay associated with the user based on the second audio signal; and providing a first playback offset to the first audio device and a second playback offset to the second audio device, the first playback offset and the second playback offset based on the first delay and the second delay.

12. The method as recited in claim 11, further comprising:

determining a third delay associated with the first audio device based on the second audio signal, the second audio signal also including sound output by the first audio device; and determining a fourth delay associated with the second audio device based on the first audio signal, the first audio signal also including sound output by the second audio device; and wherein the first playback offset and the second playback offset are based at least in part on the third delay and the fourth delay.

13. The method as recited in claim 11, wherein the first playback offset is applied to a first output signal associated with the first audio device and the second playback offset is applied to a second output signal associated with the second audio device to substantially synchronize the first output signal with the second output signal.

14. The method as recited in claim 13, wherein the first playback offset and the second playback offset are synchronized for a location of the user indicated by the first delay and the second delay.

15. The method as recited in claim 13, wherein the first output signal and the second output signal are substantially identical outputs.

16. The method as recited in claim 13, wherein the first output signal and the second output signal are different parts of a single audio content item.

17. A device comprising:

one or more microphones;

one or more communication interfaces;

one or more processors; and computer-readable storage media storing computer-executable instructions, which when executed by the one or more processors cause the processors to perform operations comprising:

capturing, via the one or more microphones, sound from an environment, the sound including noise generated by a user and first audio output by a remote audio device that is co-located with, but remote from, the device;

receiving, at the one or more communication interfaces from the remote audio device, an indication of a first local delay related to second audio output by the device;

determining, at the device, a first user delay based on the noise generated by the user;

determining, at the device, a distance of the user from the device based on the indication of the first user delay; and applying, by the device, a playback offset to the second audio based at least in part the indication of the first local delay and the distance of the user from the device.

18. The device as recited in claim 17, wherein the operations further comprise:

receiving, at the device an indication of a second additional delay from the remote audio device; and determining a location of the user based at least in part on the indication of the first local delay and the indication of the second additional delay.

19. The device as recited in claim 17, wherein the first audio is substantially identical to the second audio.

20. The device as recited in claim 17, wherein the first audio is related to the second audio.

21. The device as recited in claim 17, wherein the operations further comprise:

determining a second additional delay associated with the device based on the first audio; and determining a location of the user based at least in part on the indication of the first local delay and the second additional delay.

* * * * *